US006003258A

United States Patent [19]

Godfrey et al.

[11] Patent Number: 6,003,258

[45] Date of Patent: Dec. 21, 1999

[54] ADJUSTABLE DISPLAY PANEL

[76] Inventors: Don Godfrey; Amal Godfrey, both of 7871 Compass Lake Dr., San Diego, Calif. 92119

[21] Appl. No.: 08/984,439

[22] Filed: Dec. 3, 1997

[51] Int. Cl.[6] ..... G09F 13/04

[52] U.S. Cl. ..... 40/611; 40/574; 40/576; 40/775; 40/776

[58] Field of Search ..... 40/576, 575, 611, 40/618, 620, 771, 772, 775, 776

[56] References Cited

U.S. PATENT DOCUMENTS

| | | | |
|---|---|---|---|
| 3,018,728 | 1/1962 | Devon et al. | 40/620 X |
| 4,756,106 | 7/1988 | Foster | 40/611 X |
| 4,884,351 | 12/1989 | Abramson | 40/618 X |
| 5,088,221 | 2/1992 | Bussiere et al. | 40/618 |
| 5,343,646 | 9/1994 | Cobb et al. | 40/618 X |
| 5,457,905 | 10/1995 | Kaplan | 40/611 X |
| 5,588,238 | 12/1996 | Visocky et al. | 40/618 |
| 5,636,463 | 6/1997 | Sharon et al. | 40/618 |
| 5,676,444 | 10/1997 | Liao | 40/575 X |

FOREIGN PATENT DOCUMENTS

| | | | |
|---|---|---|---|
| 1188884 | 9/1959 | France | 40/576 |

*Primary Examiner*—Cassandra H. Davis

*Attorney, Agent, or Firm*—Knobbe, Martens, Olson & Bear, LLP

[57] ABSTRACT

An adjustable display panel having one or more individual sign elements slidably mounted between partitioning elements attached laterally to the frame. In one embodiment, a plurality of partitioning elements are magnetically attached to the frame using a series of apertures in the frame. The partitioning elements each include a sliding track or groove for slidably receiving one edge of the sign elements therein. A removable stop element is provided on at least one side of the frame to permit easy access to the sign elements in order to facilitate modification or replacement thereof. The sign elements of the present invention further comprise a front and rear portion, these portions being separable from one another. The front portion of the sign element, which contains graphic images or writing, may be separated from the rear portion and replaced. Additionally, the rear portion of each sign element includes one or more pockets having alphanumeric inserts which are readable through apertures in the front portion of the sign element, these inserts also being replaceable.

7 Claims, 12 Drawing Sheets

FIG. 21

ADJUSTABLE DISPLAY PANEL

BACKGROUND OF THE INVENTION

1. Field of the Invention

The invention relates to signs and more particularly, to an improved, adjustable display panel for back-lighted signs.

2. Description of the Related Art

Back-lighted signs are frequently used for advertising and promotion. Generally, in a back-lighted sign, an opaque message and/or picture is secured within a display panel. The display panel is typically mounted to a housing which includes a front wall, a rear wall, a top wall, a bottom wall and two side walls, wherein the top, bottom and side walls are peripherally joined to the front and rear walls, thereby defining a cavity within the housing. The front wall typically includes an aperture therein so that a light mounted within the cavity may shine through the aperture and illuminate a display panel attached to the front wall. The light illuminates the display panel and accentuates the message/picture on the display panel during the day and illuminates the message/picture at night.

Back-lighted signs, of the type described above, are typically found above counters in fast food restaurants. Often, such signs consist of a number of display panels with each panel displaying a different category of menu items and corresponding prices. For example, one panel may list hot sandwiches, with another panel for cold sandwiches, and yet another panel may list beverages and desserts. A display panel may also display a photographic reproduction of a food item being offered for sale in order to create customer interest.

Because display areas vary from restaurant to restaurant, and because of a need to create a distinctive appearing sign for different restaurants, modular sign systems have been devised. Such sign systems are typically created by attaching side-by-side a number of square, or rectangular, sign modules, each having a housing which contains lightbulbs for illuminating a translucent display panel attached to a front wall of the housing. Such rectangular modules can be combined horizontally or vertically, or in a two-dimensional array to form different sized and shaped sign assemblies. An example of such a modular sign system is disclosed in U.S. Pat. No. 5,379,540 to Howard, entitled "MODULAR SIGN SYSTEM."

However, even with the above-described modular sign system, within a single given sign module, the display cannot easily be changed. Typically, within each display panel a specified number of image slides and/or photographic gels (referred to as "sign elements" herein) are inserted into a frame which surrounds a specified number of display windows, each configured to hold an individual sign element. For each of these display panels, the number of display windows and the size of each display window is fixed, or at the very least, extremely cumbersome to alter. Therefore, within a single given sign module, the number of items that may be displayed is not easily changed. Additionally, if one desires to change the size of a particular sign element, the old display panel must be replaced by a new display panel having a display window which matches the size of the desired sign element, or the frame of the display panel must be completely dismantled and reconfigured to provide the appropriately sized display window. These prior art display panels are not designed and constructed to be altered after the first time they have been assembled. Therefore, changing the configuration of the display windows within these display panels is tedious and time consuming.

One example of a prior art display panel is illustrated and disclosed in U.S. Pat. No. 4,277,904 to Leuthesser, entitled, "Back Lighted Sign Frame." Leuthesser discloses a frame which surrounds a specified number of display windows, each display window capable of displaying a desired advertisement or other image therein. Multiple display windows may be created by dividing a particular display window with a partitioning member. However, once this display panel is created, it is not designed to be altered. Leuthesser discloses that each partition member is secured to the frame by means of tabs which extend longitudinally outwardly from each end of the partitioning member to be inserted into slots located on the frame. Leuthesser further discloses "suitable glue or other adhesive applied to the tabs to secure the [partitioning] member in the proper position . . . ." However, even without glue or adhesive, in order to remove a particular partitioning member from the frame of the display panel disclosed by Leuthesser, one must flex and/or bend the partitioning member so as to dislodge the tabs attached to the ends of the partitioning member from their respective slots. This process often results in bent, broken, or otherwise damaged partitioning members and, additionally, is a clumsy and tedious process to undertake. Furthermore, the process of removing the partitioning members sometimes causes damage to the peripheral frame itself.

Therefore, prior art display panels do not provide a fully satisfactory method or system for adjusting the display panel so as to receive and display different sizes and/or numbers of sign elements. Therefore, there is a need to provide an adjustable display panel which may be quickly and easily modified so as to be able to accommodate different sizes and/or numbers of sign elements, as menu items change, for example.

Another deficiency of prior art display panels relates to the sign elements themselves. These sign elements are typically sheets of plastic material which are die cut and stamped into a desired geometirc configuration and have printed onto them a desired logo, name, message, etc. The sign elements are typically translucent such that they may be illuminated by a light source which shines light onto the backside of the sign element. Prior art sign elements typically consist of a front piece which is a rectangular-shaped plastic sheet having an image printed thereon. The front piece is permanently attached to a back piece which is a congruently shaped plastic sheet typically having a white, or off-white, color. Typically, the front piece includes multiple windows cut therein for allowing alphanumeric characters to be displayed therethrough. Pockets are formed between the first and second pieces at positions corresponding to the windows cut in the front piece. The pockets are typically formed by placing strips of double-sided adhesive tape between the front piece and back piece such that a pocket is defined between two adjacent strips which are laterally positioned across the width of the front and back pieces. The thickness of the double sided adhesive tape and the space between adjacent strips define the geometry of a respective pocket.

In order to display a price for a menu item, for example, numerical inserts are inserted into the pockets, and each numeral printed on an insert is visible through a respective window cut in the front piece. If the price of that particular menu item is changed, it is a relatively simple matter to replace the numerical inserts with new numerical inserts. However, if a new menu item, altogether, is desired to be displayed within a particular display window, the entire sign element which displays the old menu item must be replaced with a new sign element which illustrates the new menu item. This is not cost effective because both the front and back pieces of the sign element must be discarded, and additionally, the pockets formed between the front and back pieces are also wasted. Although the formation of the pockets is not expensive in terms of materials required, it does require extra manufacturing time and processing to form the pockets, which significantly adds to the manufacturing cost for each sign element. On the other hand, the printing and cutting of only the front piece is a relatively simple process and may be performed automatically by any one of a number of well-known printing machines.

Therefore, when a sign element is to be changed, it is desirable to be able to replace only the front piece of the sign element while retaining the back piece and the pockets for further use. This would not only decrease the amount of wasted materials (e.g., plastic sheeting) to less than one half of previous amounts, but, additionally, would save a significant amount of manufacturing steps and processing time which would otherwise be required to form pockets between the front and back pieces of a sign element.

SUMMARY OF THE INVENTION

The invention addresses the above and other needs by providing an adjustable display panel assembly in which a display window may be easily and adjustably partitioned into various desired configurations so as to accommodate a desired number of sign elements of varying sizes and shapes. Therefore, the display panel assembly of the invention may be easily and repeatedly modified to provide different configurations of displays such that new messages, menu items, images, etc. of varying sizes and dimensions may be implemented in the display panel assembly, without changing the overall size of the display panel. Additionally, the invention provides an improved sign element to be used in the adjustable display panel, wherein a front piece is removably attached to a back piece, such that when an old menu item, for example, is to be replaced with a new one, only the front piece of the sign element need be replaced.

In a first aspect of the invention, an improved display panel having a frame and adjustable partitioning elements is provided. In one embodiment, the frame is of a unitary construction having a series of apertures located longitudinally therein, and constructed of a ferrous material such that magnet elements located on each of the aforementioned partitioning elements are received by and fit within respective apertures in the frame, the magnet elements being attracted to the ferrous frame. Individual sign elements are received within grooves or tracks located on each of the partitioning elements such that each individual sign element may slide in and out of the display panel, thereby facilitating easy removal and alteration. The partitioning elements may also be easily moved to other apertures within the frame to accommodate sign elements of varying sizes.

In a second aspect of the invention, an improved display panel cover is disclosed which is substantially conformal with the display panel frame and which allows rapid removal and reattachment. In one embodiment, the cover is fabricated from a transparent, flexible material sized to fit within a recess in the aforementioned frame. The cover further includes a plurality of magnetic strips around its periphery which allow the cover to be held in a fixed position relative to the ferrous frame, yet the same time be easily removed.

In a third aspect of the invention, an improved sign element is disclosed for use within the display panel described herein, or other types of backlighted display panels requiring individual sign elements. In one embodiment, the sign element includes a front piece having a window cut therein, and a substantially transparent back piece with an insert pocket for holding an alphanumeric insert which shows through the window in the front piece when the front and back pieces are mated together. The front and back pieces are removably mounted to one another such that both the front piece (typically carrying an image or lettering next to the window) and the insert may be readily removed and altered or replaced.

In a fourth aspect of the invention, methods of fabricating the aforementioned display panel, removable cover, and sign elements are also disclosed.

DETAILED DESCRIPTION OF THE PREFERRED EMBODIMENT

The invention is described in detail below with reference to the Figures, wherein like elements are referenced with like numerals throughout.

Figure 1:
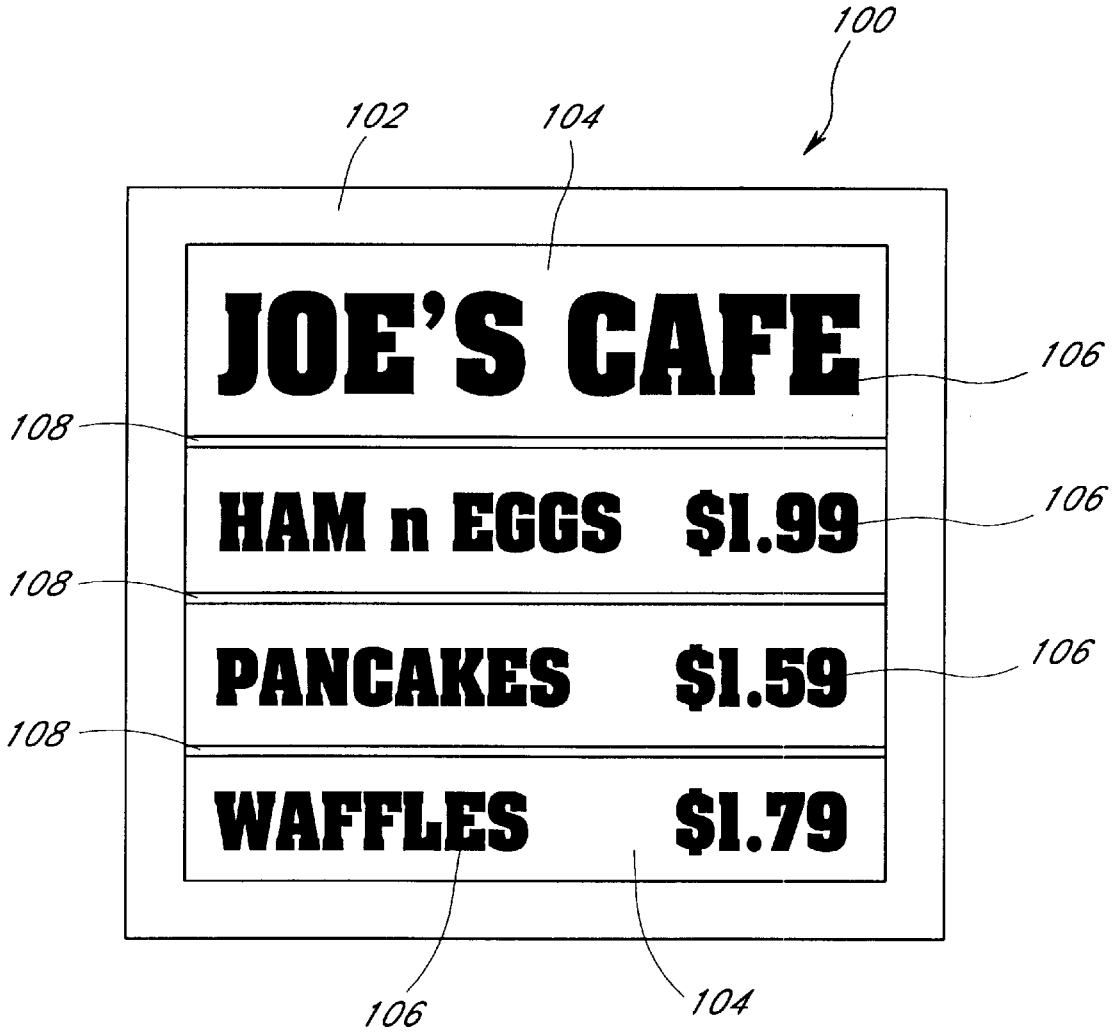
FIG. 1 illustrates a front view of one embodiment of a display panel assembly in accordance with the invention.

Referring to FIG. 1, a display panel assembly 100, in accordance with one embodiment of the invention, is illustrated. The display panel 100 includes a peripheral frame 102 which provides a support structure that surrounds sign elements 104. The sign elements 104 are commonly called slides, or photo gels, and are typically made from a translucent plastic which when radiated with light from a light source from behind, provides an illuminated advertisement or message which is quite aesthetically pleasing. The sign elements 104 typically include lettering and/or numbers 106 which are either printed or die-cut, or stamped, into the sign element 104. When illuminated from behind, these alphanumeric characters 106 typically radiate a light of a different color from that of the rest of the sign element 104, thereby accentuating the alphanumeric characters 106. The display panel assembly 100 further includes removable and adjustable partitioning elements 108 which partition the display area into two or more display areas, each capable of holding and displaying a unique sign element 104.

Figure 2:
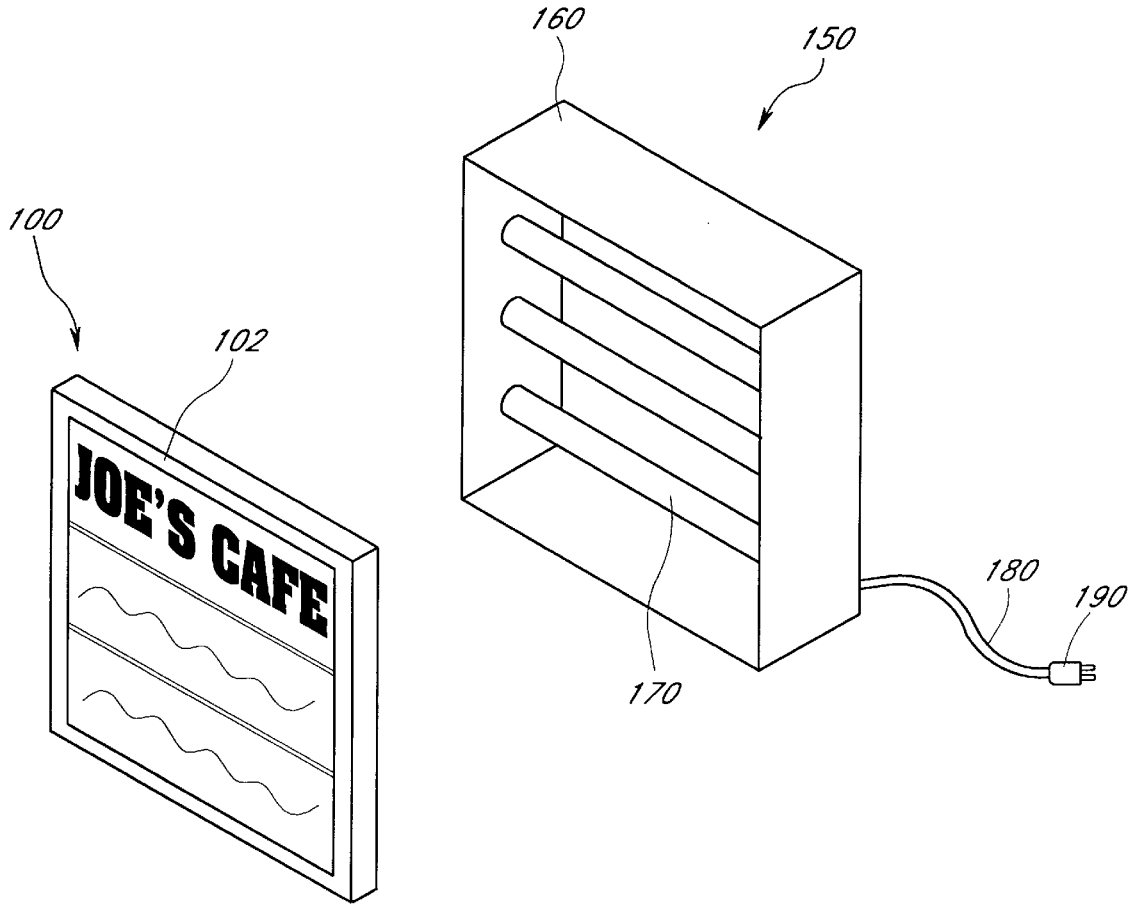
FIG. 2 is a perspective view of the display panel assembly of FIG. 1 as it is being attached to a housing for a backlighted sign system having a light source for illuminating the panel display attached to a front wall of the housing.

FIG. 2 illustrates a perspective view of the display panel assembly 100 of FIG. 1 as it is being installed into a back-lighted sign assembly 150. As shown in FIG. 2, the back-lighted sign assembly 150 includes a housing 160 for holding light sources 170 therein. Typically, these light sources are fluorescent light bulbs which are well-known in the art. The housing 160 has an open front face which has a perimeter of similar geometrical dimensions as the perimeter of the frame 102 of the display panel 100, thereby allowing the display panel 100 to properly mate with the housing 160 such that the display panel 100 properly fits over the open cavity/face of the housing 160. The display panel 100 may be secured, or attached, to the housing 160 by any means which is well-known in the art. The back-lighted sign assembly 150 further includes an electrical cord 180 having an electrical plug 190 for insertion into an electrical power outlet (not shown).

Figure 3A:
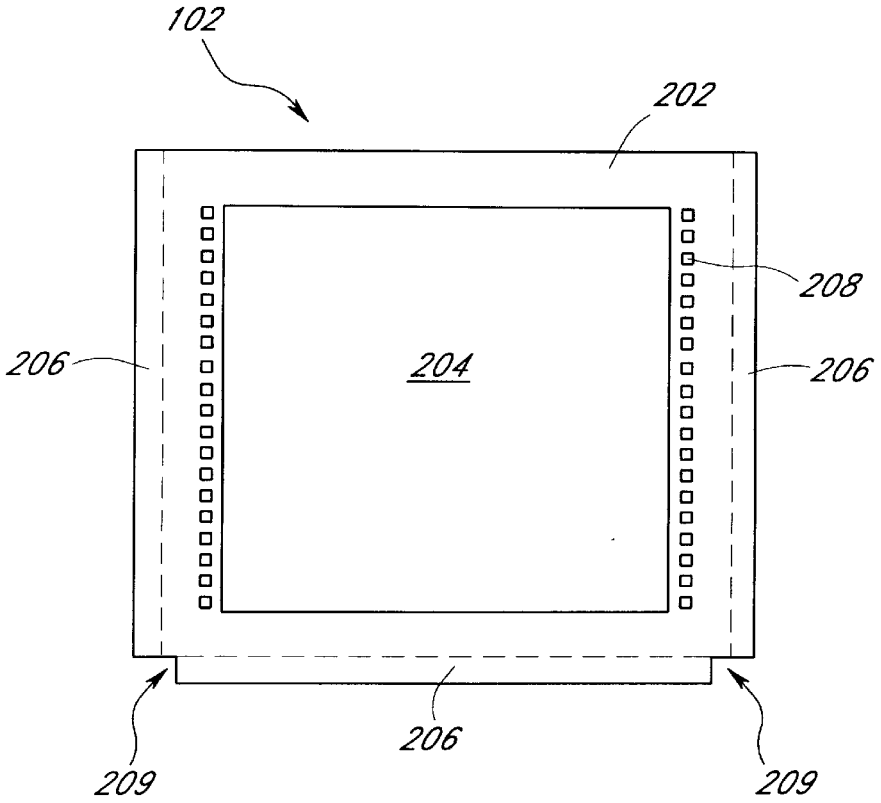
FIG. 3A illustrates a top view of a die-cut piece of sheet metal which forms the frame of the display panel of FIG. 1 in accordance with one embodiment of the invention.

FIG. 3A illustrates one embodiment of the frame 102 of FIG. 1 as it appears after a certain number of manufacturing process steps have been performed. As shown in FIG. 3A, the frame 102 includes a substantially square, or rectangular, sheet of metal, which has been cut into a specified geometrical shape and pattern. The frame 102 includes a square, or rectangular, display window 204 which has been cut in the center or internal region of the metal sheeting 202. In one embodiment, the metal sheeting 202 is an aluminum sheet having a specified thickness. However, the invention is not limited to any particular type of sheeting, metal or otherwise, and other types of sheeting or materials such as steel, plastics, etc., may be used in accordance with the invention. The sheeting 202 is cut such that flange elements 206 are formed along the left and right perimeters, and the bottom perimeter of the frame 102.

As shown in FIG. 3A, the sheeting 202 has multiple partitioning apertures 208 cut adjacent to the left and right internal perimeter edge of the frame 102. The functionality and purpose of these multiple partitioning apertures 208 are described in further detail below with respect to FIGS. 15–18. The sheeting 202 is also cut such that a rectangular corner section is cut away from the bottom left and right corners as shown by reference numerals 209. The purpose of these cut-away corner sections 209 is to allow the flange elements 206 to be folded over, along the dashed lines shown so as to provide a flanged perimeter, or edge, of the frame 102. The flanged edge reinforces the strength and support provided by the frame as the thickness along the flanged edge regions is twice that of the rest of the frame. As discussed in further detail below, the flanged edges 206 also provide a boundary for a transparent cover panel (not shown) which attaches to the front face of the frame 102.

Figure 3B:
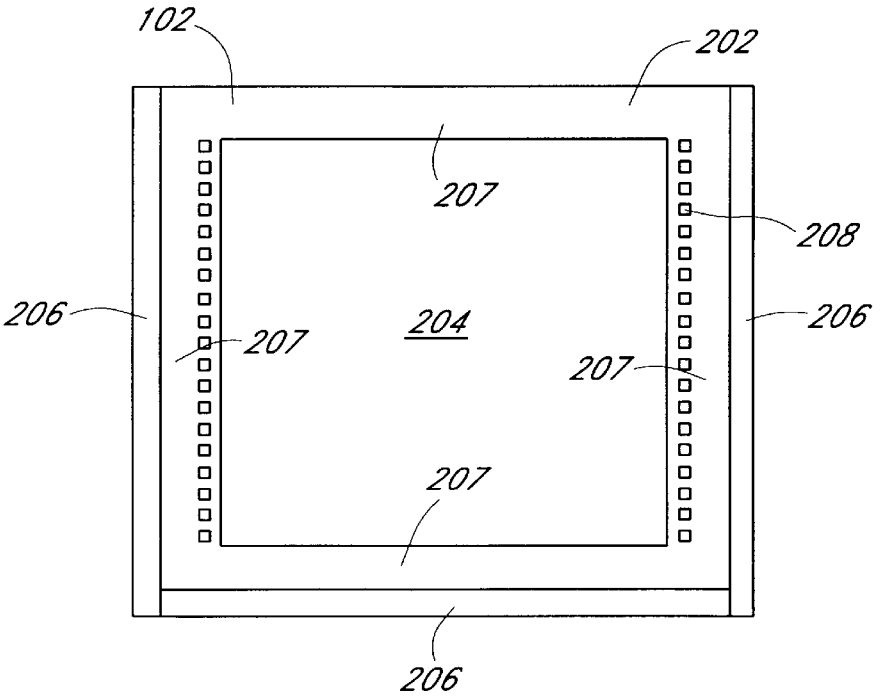
FIG. 3B illustrates the die-cut piece of sheet metal of FIG. 3A after it has been bent and/or folded to form desired peripheral flanged edges in accordance with one embodiment of the invention.

FIG. 3B illustrates a front view of the frame 102 after the flange elements 206 have been folded, as described above, in order to form the flanged edge/perimeter of the frame 102. As can be seen from FIG. 3B, the flange perimeter portions 206 are of twice the thickness as the rest of the sheeting 202, and therefore, are raised above the rest of the sheeting 202 by an amount equal to the thickness of the sheeting. Therefore, the raised flanged edges 206 surround ledge portions 207 which define the internal perimetric regions of the frame 102. It is further appreciated that the flanged edges 206 of the frame 102 increase the strength and durability of the frame 102.

Figure 4:
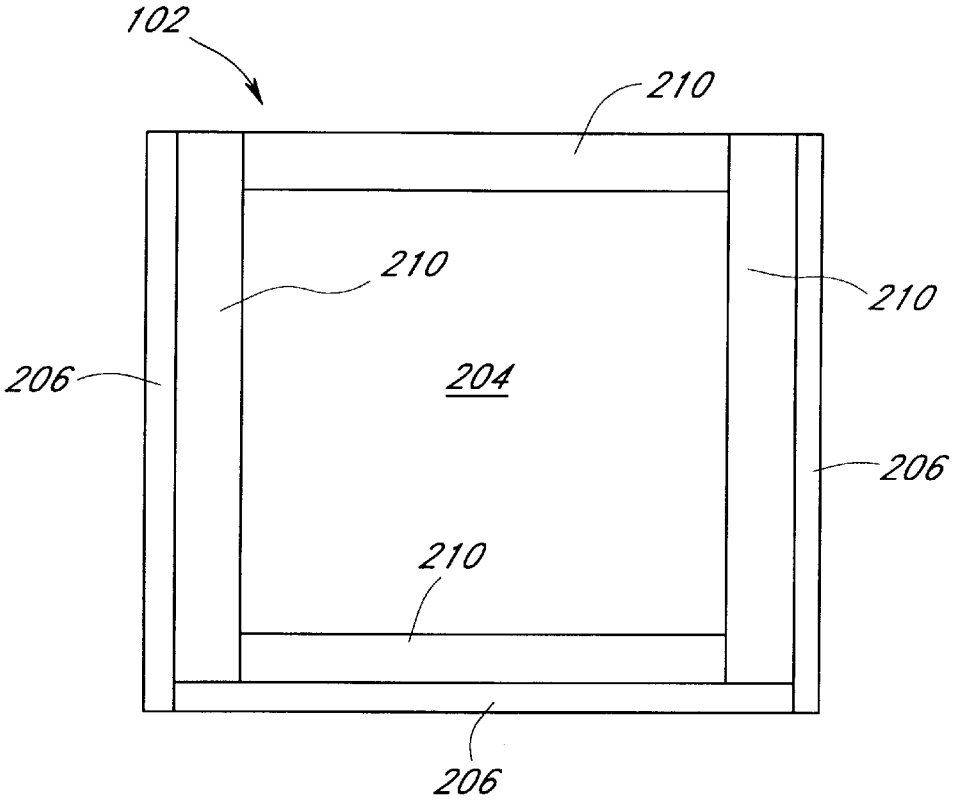
FIG. 4 illustrates a top view of the frame formed as shown in FIG. 3B after thin strips of steel sheeting have been attached to the internal peripheral ledges of the frame in accordance with one embodiment of the invention.
Figure 5:
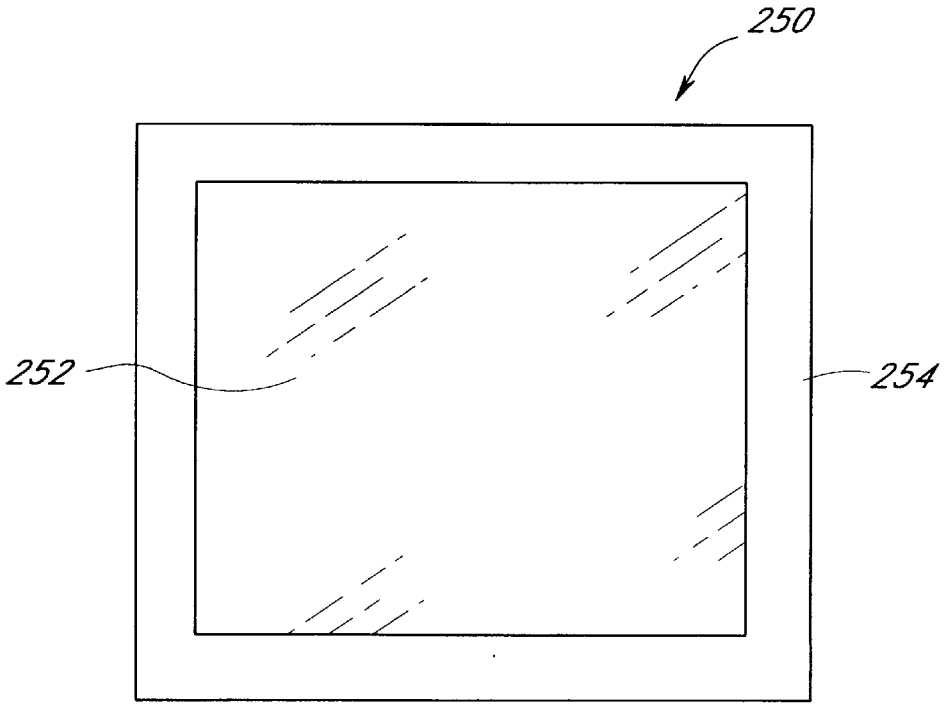
FIG. 5 illustrates a front view of a transparent cover panel which mates with the frame of FIG. 4 in accordance with one embodiment of the invention.

FIG. 4 illustrates the frame 102 of FIG. 3B after strips of steel sheeting 210 have been attached to the interior ledges 207 of the frame 102. The purpose of the steel sheet strips 210 is to provide a means for magnetically holding a transparent cover panel 250 as illustrated in FIG. 5. The steel strips 210 may be attached to the ledge portions 207 by any means which is well-known in the art, such as, for example, double-sided adhesive tape, glue, etc. The transparent cover panel 250, as illustrated in FIG. 5, includes a transparent sheet of plastic, or other suitable transparent material, which is cut in a shape and size which corresponds to the internal perimetric boundaries formed by the flanged portions 206 of the frame 102, as illustrated in FIG. 4. The transparent cover panel 250 also includes a perimetric border 254 which is either printed, painted or otherwise formed around the perimeter of the plastic sheet material 252, thereby forming a colored border for the transparent cover panel 250. Typically, the perimetric border 254 is printed such that it is of a matching color as the frame 102 so as to provide an appearance of continuity between the frame and the transparent cover panel. The perimetric border 254 may also be formed by means of applying tape to the perimeter of the plastic sheeting 252. In one embodiment, the width of the perimetric border 254 corresponds to the width of the ledge portions 207 formed on the frame 102 as described above.

Figure 6:
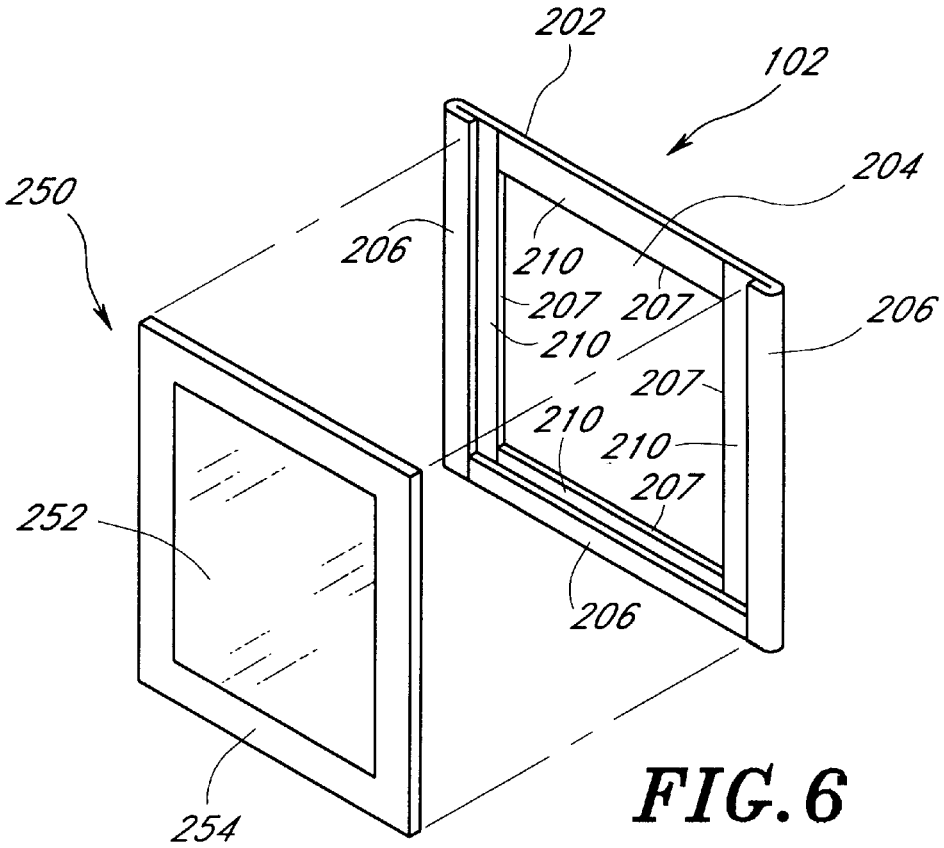
FIG. 6 illustrates a perspective view of the transparent cover panel of FIG. 5 as it is being attached to the frame of FIG. 4.

Referring to FIG. 6, a perspective view of the frame 102 and the transparent cover panel 250 as it is being attached to the frame 102 is illustrated. As shown in FIG. 6, the transparent cover panel 250 mates with the frame 102 such that the geometry of the outside perimeter of the transparent cover panel 250 substantially corresponds to the outside perimeter geometry of the ledge portions 207, defined by the raised flanged edges 206 on a top edge of the metal sheeting 202, of the frame 102.

Figure 7:
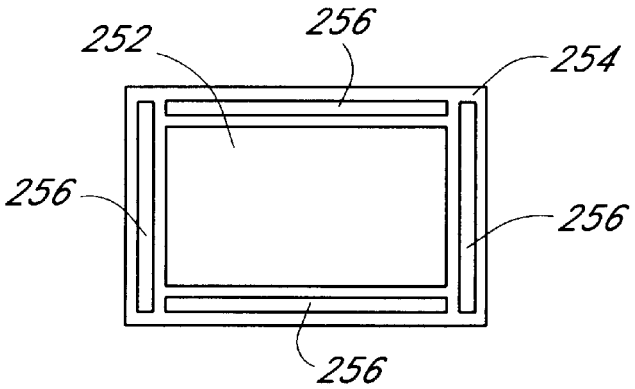
FIG. 7 illustrates a back view of the transparent cover panel of FIG. 5 which illustrates magnetic strips attached to peripheral areas of the transparent cover panel so as to magnetically attach the transparent cover panel to the steel strips which are attached to the frame of FIG. 4.
Figure 8:
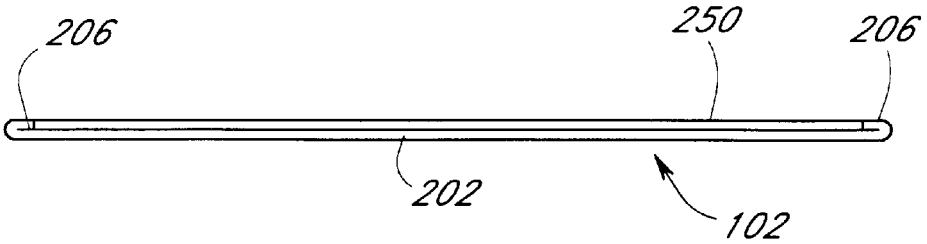
FIG. 8 illustrates a top view of the transparent cover panel after it has been attached flushed with the frame of FIG. 4 in accordance with one embodiment of the invention.

FIG. 7 illustrates a back-side view of the transparent cover panel in which magnetic elements are attached to the border areas 254 of the cover panel 250. In one embodiment, the magnetic elements 256 are thin strips of flexible ferric magnetic material made from a rubber compound mixed with various chemicals having magnetic properties, such as ferrite and strongium, for example. Such types of flexible ferric magnets are well-known in the art and are manufactured by companies such as Magnet Source, Inc. of Denver, Colo., for example. In one embodiment, the magnetic elements 256 are attached to the border areas 254 by means of a double-sided adhesive tape, glue, or other attaching means which is well-known in the art. The magnetic elements 256 serve to hold a transparent cover panel flush against the ledge portions 207 of the frame 102. FIG. 8 illustrates a top view of the transparent cover panel 250 after it has been magnetically attached to the frame 102.

As illustrated in FIG. 8, after the transparent cover panel 250 has been magnetically attached to the frame 102, the cover panel 250 is flush with the flanged borders 206 so as to provide an appearance that the cover panel 250 and the frame 102 are a single, unitary piece.

Figure 9:
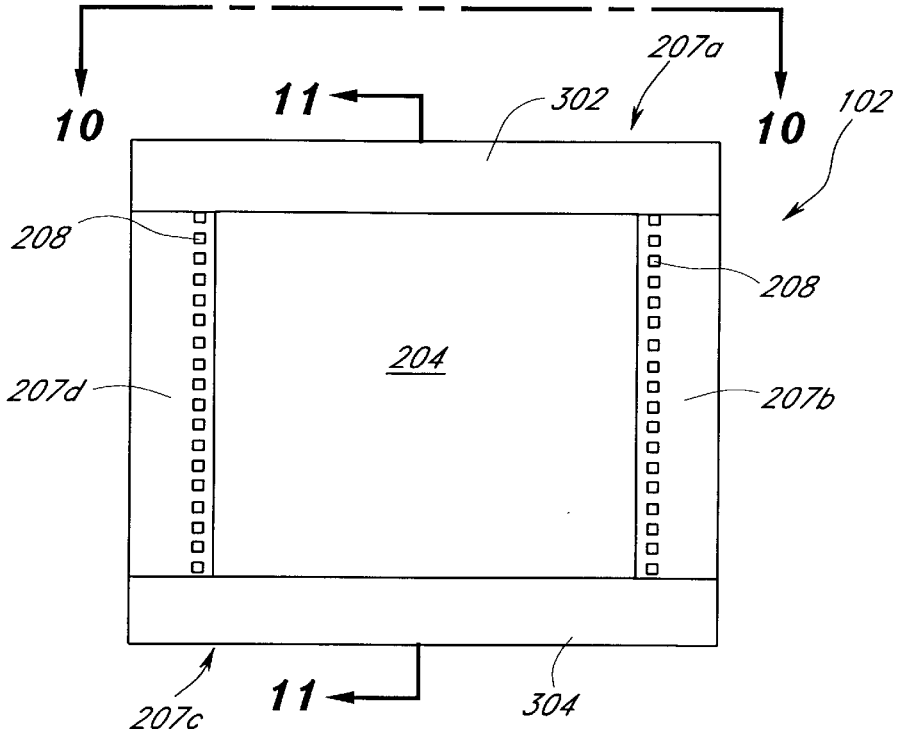
FIG. 9 is a back-side view of the frame assembly of FIG. 4 in accordance with one embodiment of the invention.

FIG. 9 illustrates a back-side view of the frame 102 in accordance with one embodiment of the invention. The frame 102 includes top and bottom retention members 302 and 304, respectively, attached to the top boundary portion of the frame 102 and the bottom boundary portion of the frame 102, respectively. The frame 102 further includes partitioning apertures 208 formed along the internal perimetric borders of the vertical ledge portions 207*b* and 207*d* of the frame 102. Although the partitioning apertures 208 are illustrated as square or rectangular apertures, they are not limited to this configuration. Any desired geometric configuration may be used in accordance with the invention.

Figure 10:
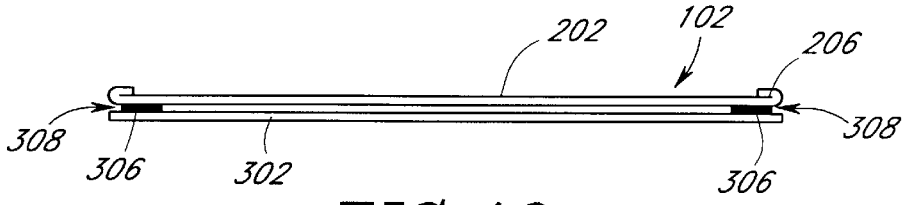
FIG. 10 is a top view, taken along lines 10—10 of FIG. 9, of the frame assembly of FIG. 9.

FIG. 10 illustrates a top view, taken along lines 10—10 of the frame 102 of FIG. 9 having the top retention member 302 attached thereto by a double-sided adhesive tape 306. In one embodiment, the double-sided adhesive tape 306 is of a specified thickness so as to provide a specified spacing 308, or channel 308, between the top retention member 302 and the back-side of the frame 102.

Figure 11:
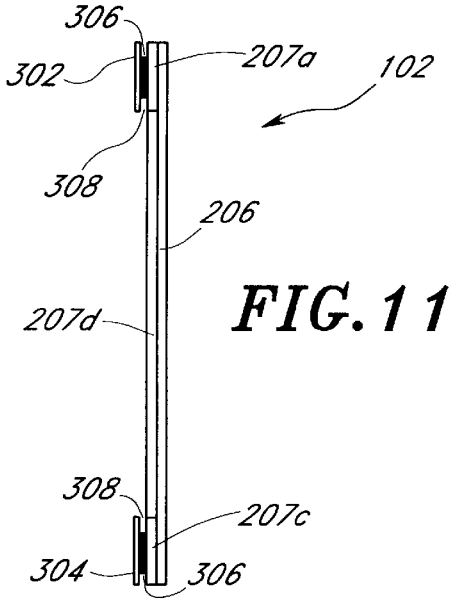
FIG. 11 is a cross-sectional, side view, taken along lines 11—11, of the frame assembly of FIG. 9.

FIG. 11 shows a side-view of the frame assembly 102, taken along lines 11—11 of FIG. 9. As shown in FIG. 11, the frame assembly 102 has a top retention member 302 attached to the back side of a top ledge 207*a* by means of a double-sided adhesive tape 306. The double-sided adhesive tape 306 is of a specified thickness so as to provide a channel 308 which serves to hold an edge of a slide or photo gel, as will be described in further detail below with respect to FIG. 12, 13 and 14. FIG. 11 also illustrates the bottom retention member 304 attached to a bottom ledge portion 207*c* by means of double-sided adhesive tape 306. As described above, the thickness of the double-sided adhesive tape 306 is of a specified value so as to provide a channel 308 for receiving therein an edge of a slide or photo gel (i.e., sign element). The ledge portion 207*d* and its corresponding flanged border 206 are also illustrated in FIG. 11. Referring again to FIG. 9, the geometric relationship between the ledge portions 207*a*, 207*b*, 207*c* and 207*d* is clearly shown. In the side view of FIG. 11, the horizontal ledge elements 207*a* and 207*c* extend outwardly from the page and the vertical ledge portion 207*d* and its flanged border 206 are further back in the page and attach to the far ends of the horizontal ledge portions 207*a* and 207*c*.

Figure 12:
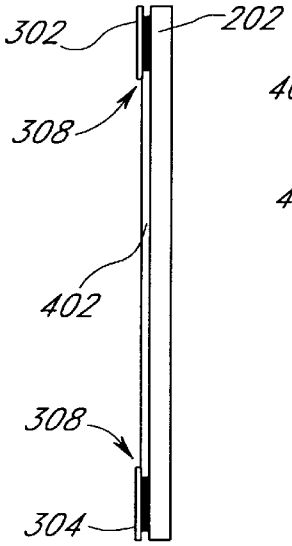
FIG. 12 is the cross-sectional, side view of FIG. 11, additionally having a slide, or photo gel, positioned within channels formed by top and bottom retention members attached to the back-side of the frame, in accordance with one embodiment of the invention.

Referring to FIG. 12, the side view of the frame assembly 102, as shown in FIG. 11, is illustrated with a photographic gel sign element 402 inserted at the backside of the frame 102 such that the sign element 402 is held within channels 308 formed between the back-side of the sheeting 202 of the frame 102 and the top and bottom retention members 302 and 304, respectively.

Figure 13:
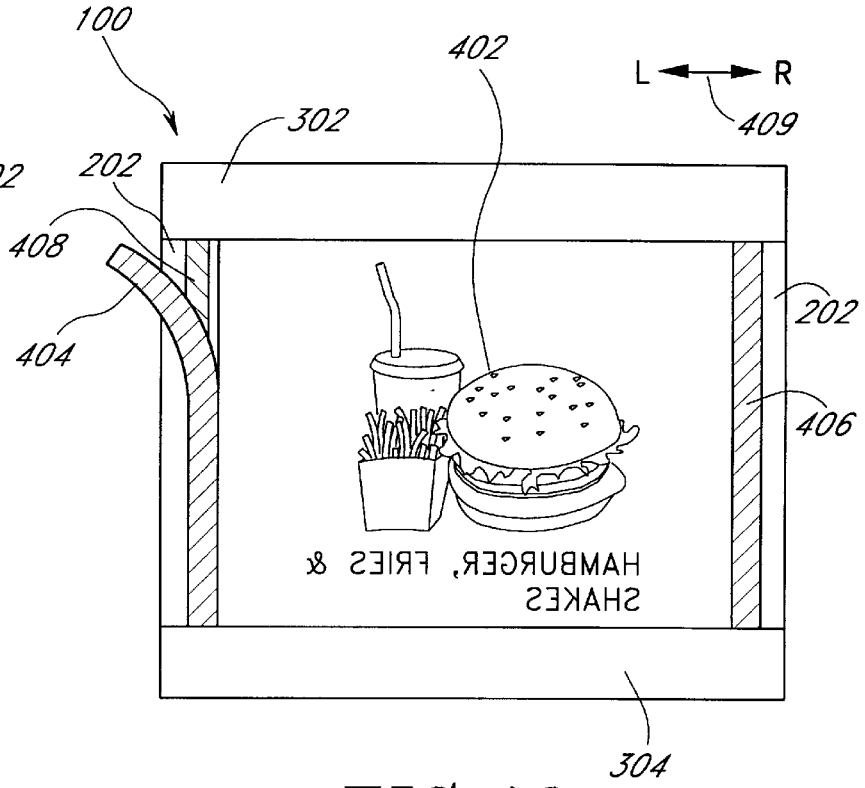
FIG. 13 is a back-side view of the display panel assembly of FIG. 12 having a photo gel positioned within the assembly and locking strips attached to the back-side of the frame in order to lock the photo gel in position within the assembly, in accordance with one embodiment of the invention.

FIG. 13 illustrates a back-side view of the display panel assembly 100 after a single large sign element 402 has been inserted into the display panel 100. The sign element 402, otherwise known as a slide or a photo gel, is retained within channels 308 (FIG. 12) formed between the top and bottom retention members 302 and 304, respectively, and the back-side of the sheeting 202 of the frame 102 of the display panel assembly 100. The display panel assembly 100 also includes a first slide stop element 404 and a second slide stop element 406. The purpose and function of the slide stop elements 404 and 406 is to prevent the sign element 402 from sliding either to the left or to the right as indicated by the double arrows 408. The slide stop elements 404 and 406 are attached to the back-side of the left and right vertical ledge portions 207 of the frame 102, respectively. In one embodiment, the slide stop element 406 is permanently attached to the back-side of the frame 202, and is made from a rubber foam material which has been laminated with a plastic sheeting on its top surface. The purpose of the slide stop element 406 is to limit the motion of the sign element 402 from sliding past the slide stop element 406, and therefore, any suitable material which is rigid and durable enough to prevent such sliding of the sign element 402 may be used in accordance with the invention. The slide stop element 406 may be permanently attached to the back-side of the frame 202 by means of a double-sided adhesive tape, glue, or any other means which is well-known in the art.

In one embodiment, the slide stop element 404, on the other hand, is removably attached to the back-side of the frame 202. When the slide stop element 404 is removed, the sign element 402 may be slid into the display panel assembly 100 within the channels 308 (FIG. 12). After the sign element 402 has been slid into place, the slide stop element 404 may then be attached to the back-side of the frame 202 so as to prevent the sign element 402 from sliding to the left as shown by directional arrows 408. In one embodiment, the slide stop element 404 is made from a flexible ferric magnetic strip having a polycarbonate surface material attached thereto. The flexible ferric magnetic strip is commercially available from Magnet Source, Inc., of Denver, Colo., for example. The flexible, magnetic slide stop element 404 may be attached to the back-side of the frame 202 by means of a thin steel strip 308 which is permanently attached to the back-side of the frame 202, as illustrated in FIG. 13. The flexible, magnetized polycarbonate slide stop element 404 is magnetically attracted to the steel strip 409, and therefore, magnetically adheres to the back-side of the frame 202.

Figure 14:
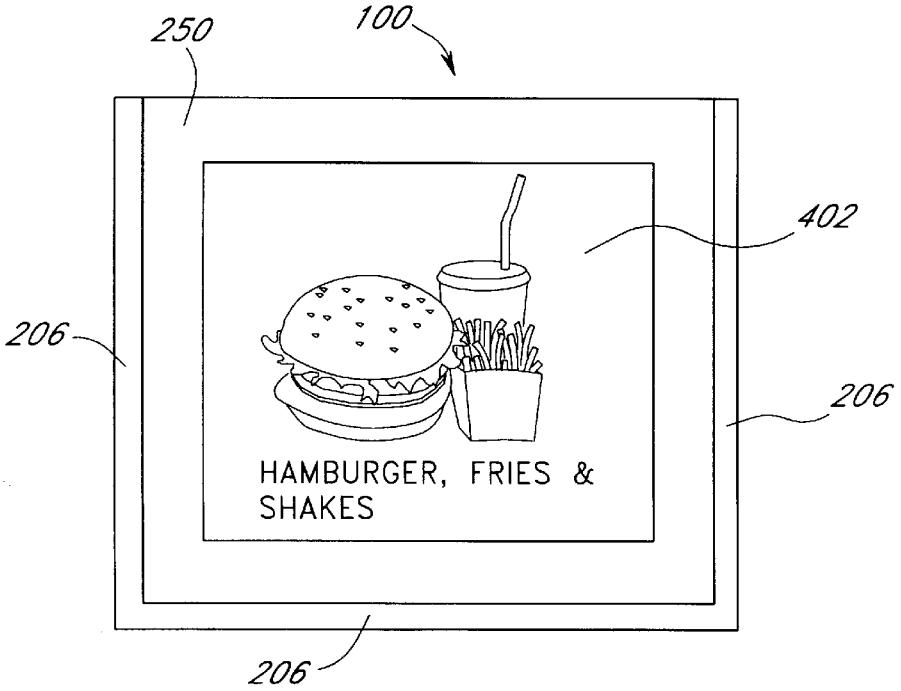
FIG. 14 illustrates a front view of the display panel assembly of FIG. 13, having a photo gel of fast-foot menu items displayed therein, in accordance with one embodiment of the invention.

FIG. 14 illustrates a front view of the display panel assembly 100 after the sign element 402 is positioned within the display panel assembly 100, as described above with reference to FIGS. 12–13. The transparent cover panel 250 is also shown covering the front surface of the sign element 402. As also shown in FIG. 14, the flanged borders ledges 206 provide a means for supporting and aligning the transparent cover panel 250 such that it is properly held and oriented with respect to the frame 102 (FIG. 6) of the display panel assembly 100.

Figure 15:
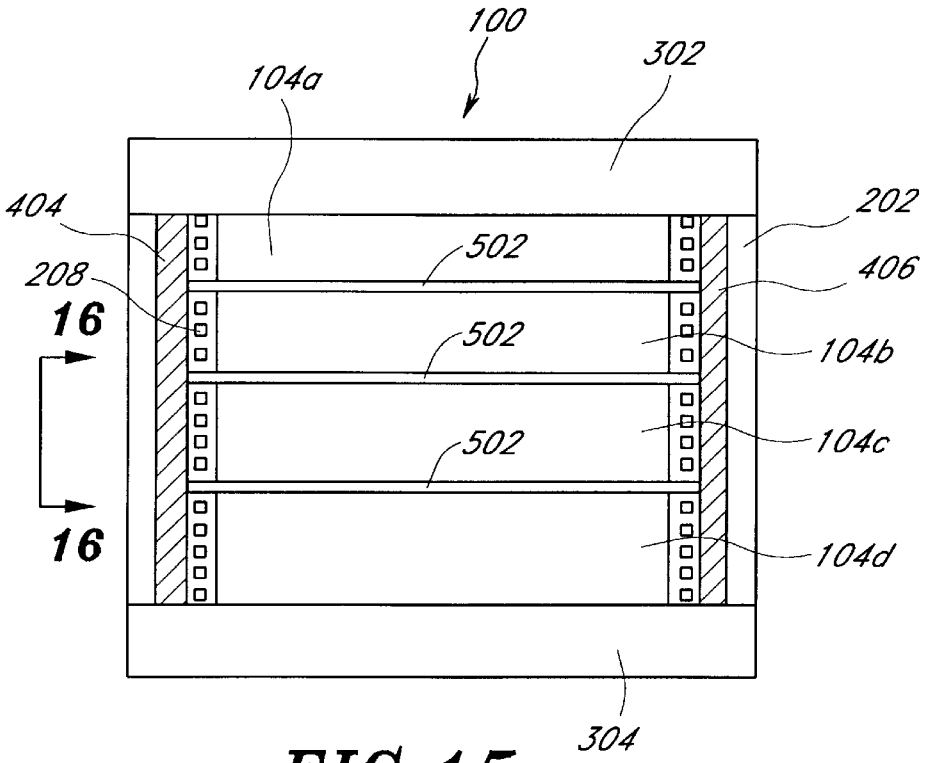
FIG. 15 is a back-side view of an adjustable display panel assembly in accordance with one embodiment of the invention.

FIG. 15 illustrates a back-side view of the display panel assembly 100 of the invention, wherein the display area 104 is partitioned into four separate display areas 104*a*–104*d* by partitioning elements 502. The display panel assembly 100 includes the top and bottom retention members 302 and 304, respectively, slide stop elements 404 and 406, and partitioning apertures 208 which are stamped, or die-cut, into the sheet 202 of the frame 102 (FIG. 3A), as described above.

Figure 16:
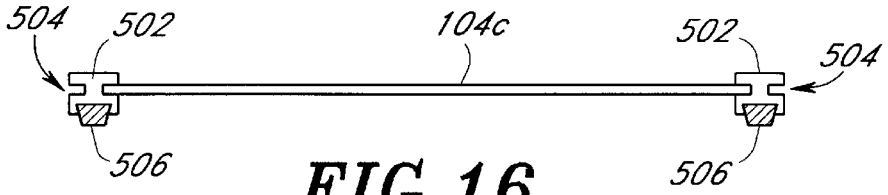
FIG. 16 illustrates a side view, when looking toward the direction of line 16—16 of FIG. 15, of two partitioning bars having a slide, or photo gel, positioned within respective channels of each partitioning bar, in accordance with one embodiment of the invention.

Referring to FIG. 16, a cross-sectional side view when looking toward a direction corresponding to line 16—16 of FIG. 15, is illustrated. Two partitioning elements 502 support and hold a sign element 104*c* within channels 504 formed within the partition elements 502 as illustrated in FIG. 16. Each of the partitioning elements 502 are attached to the frame assembly 102 (FIG. 9) by means of magnet elements 506 which are attached to each end of each partitioning element 502. The magnet elements 506 fit into the partitioning apertures 208, as described in further detail below with respect to FIG. 18. Slide channels 504 are on each side of the partitioning element 502 and run longitudinally along the length of the partitioning elements 502. Therefore, each partitioning element 502 can serve to provide a slide channel 504 for two sign elements 104 on either side of the partitioning element 502.

Figure 17:
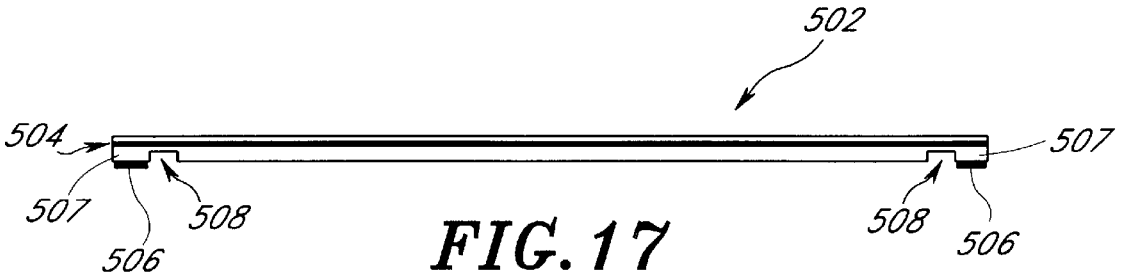
FIG. 17 illustrates an elevated side view of a partitioning bar in accordance with one embodiment of the invention.

Referring to FIG. 17, each slide channel 504 runs longitudinally and parallel to the length of the partitioning element 502. The partitioning element 502 further includes lateral indentations or grooves 508 near each end of the partitioning element 502. The indentations 508 define a locking member 507 at each end of the partitioning element 502. Attached to the bottom surface of each locking member 507 is a magnet element 506. Referring once again to FIG. 16, it is seen that the magnet element 506 is lodged into the locking member 507 by means of a beveled channel in locking member 507 which receives a bevel shaped magnet element 506, thereby securely holding the magnet element 506 within the locking member 507. In one embodiment, to further increase the adhesion between the magnet element 506 and the locking member 507, the magnet element 506 is glued into the beveled channel of the locking member 507, using any suitable glue which is well-known in the art.

Figure 18:
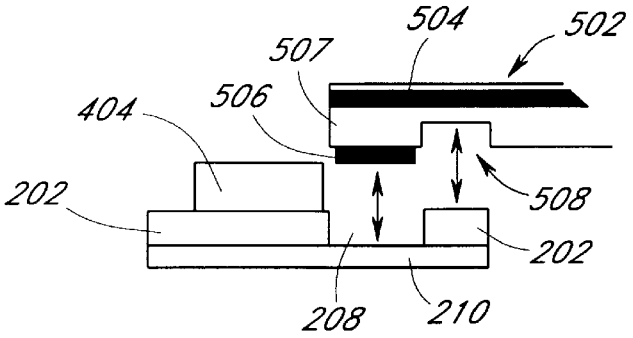
FIG. 18 illustrates a close-up, elevated, side view of the mating configuration of one end of the partitioning bar of FIG. 17 with the frame assembly of the panel display assembly of FIG. 15, in accordance with one embodiment of the invention.

Referring to FIG. 18, a close-up view of how the locking element 507 of the partitioning element 502 mates with the partitioning aperture 208 of the frame sheeting 202, is illustrated. As shown in FIG. 18, the locking member 507 locks into a partitioning aperture 208. It is desirable for the dimensions of the locking member 507 to correspond to the dimensions of the partitioning aperture 208 so as to be "formfitted" therein such that each time the partitioning element 502 is inserted into a particular partitioning aperture 208, the orientation and alignment of the partitioning element 502 will remain essentially constant. In other words, the partitioning element 502, after it has been placed in a partitioning aperture 208 should not be able to "jiggle" or shift its position, thereby providing uniform positioning of the partitioning elements 502 with respect to each partitioning aperture 208. As the locking member 507 fits into partitioning aperture 208, the lateral indentation 508 formed on the bottom side of the partitioning element 502 form fits with the portion of the frame 102 formed between the aperture 208 and the internal perimeter of the frame 102 (FIGS. 3A–3B). After the partitioning element 502 has been locked into position, as described above, it is held in its respective position by means of magnet element 506 which is magnetically attracted to the strip of steel sheeting 210 which is attached to the front surface of the frame 102, as described above with reference to FIG. 4. The slide stop element 404 prevents a slide or photo gel from sliding out of the slide channels 504 after the partitioning element 502 has been locked into place as described above.

Figure 19:
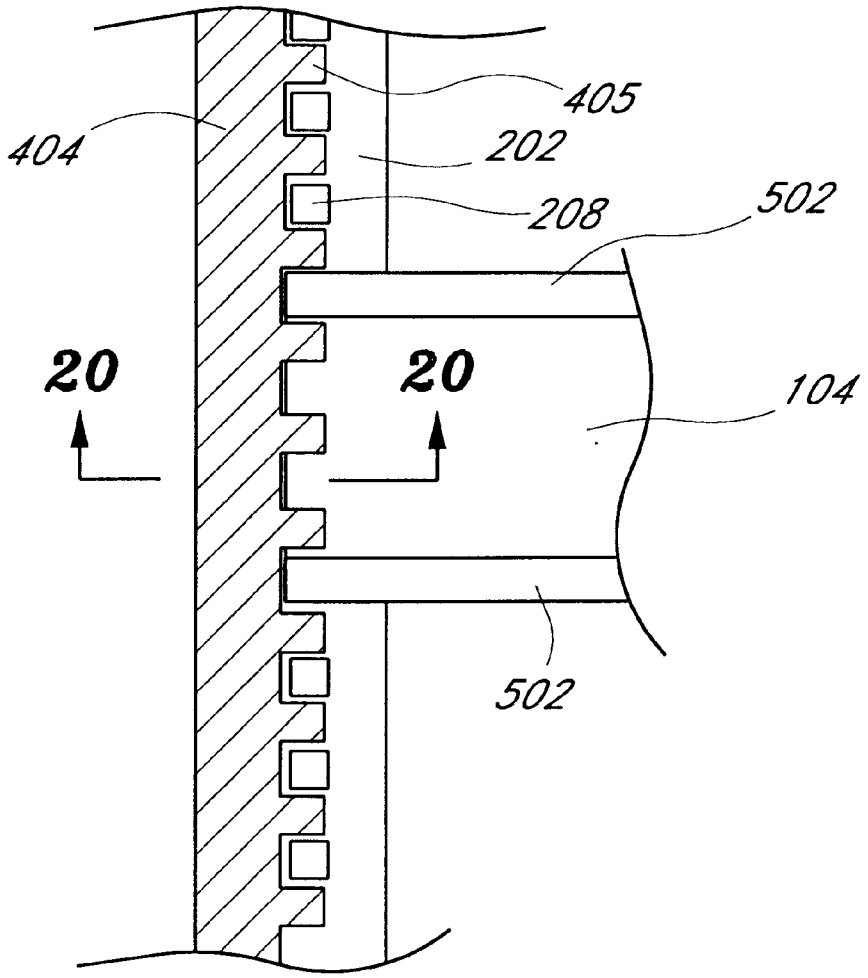
FIG. 19 illustrates a top view of a locking strip as it is positioned onto the frame of the display panel assembly, in accordance with one embodiment of the invention.

FIG. 19 illustrates one embodiment of a detachable slide stop element 404 in accordance with the invention. The removable slide stop 404 may be made from a flexible, magnetic polycarbonate material, or other suitable material that may be magnetized, or it may be a more rigid element such as a strip of magnetized metal, rubber, plastic, etc. The invention is not limited to the type of material which may be used to provide the slide stop 404. As illustrated in FIG. 19, the slide stop 404 includes multiple retention flaps 405 which are spaced and configured so as to extend between the spacings of adjacent partitioning apertures 208. In this way, the slide stop 404 not only prevents a slide or photo gel 104 from sliding out of the channels (not shown) of the partitioning elements 502, but also provides additional support and stability by holding and securing the end of the slide 104 underneath the retention flaps 405.

Figure 20:
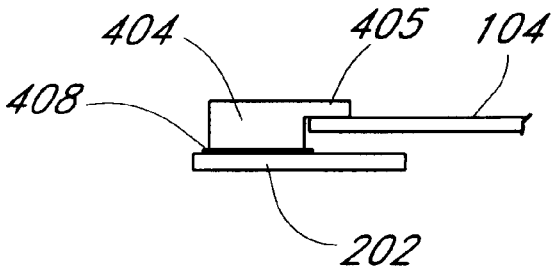
FIG. 20 illustrates a cross-sectional side view, taken along lines 20—20, of the locking strip of FIG. 19 as it is attached to the frame in order to prevent a slide from sliding out of the panel display, in accordance with one embodiment of the invention.

FIG. 20 illustrates a cross-sectional view, taken along lines 20—20 of FIG. 19, of the slide stop 404 with the retention flap 405 engaged with one end of a slide 104 so as to provide support and stability to the end of the slide 104. The slide stop 404 is removably attached to the back side of the metal sheet 202 of the frame 102 by a thin strip of steel sheeting 408, or other suitable type of sheeting having magnetic properties capable of attracting the magnetized slide stop 404.

Figure 21:
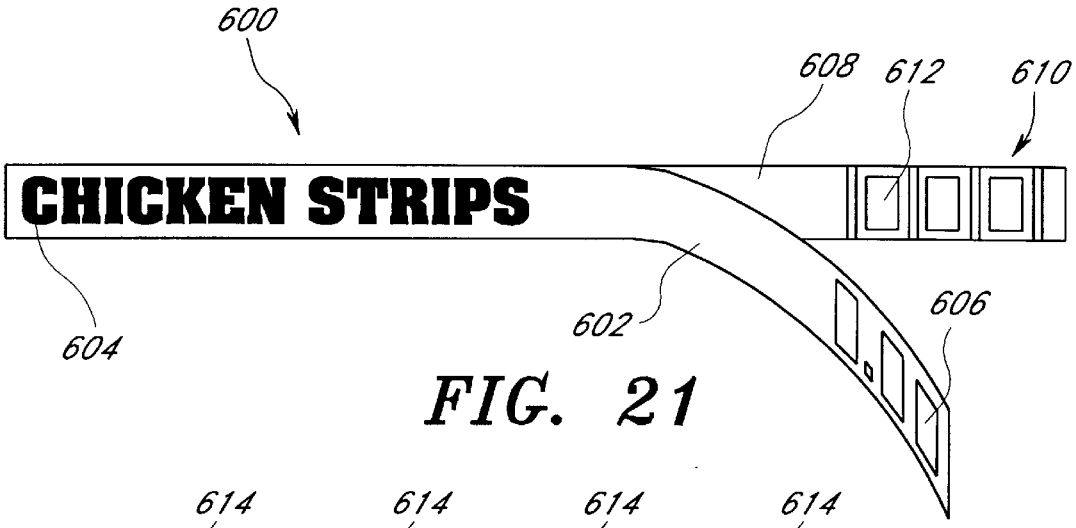
FIG. 21 illustrates an improved sign element which may be used in the display panel, in accordance with one embodiment of the invention.

FIG. 21 illustrates one embodiment of a sign element 600, otherwise known as a slide 600, which may be used in accordance with the present invention. The slide 600 includes a front piece 602 having alphanumeric characters 604 stamped, printed, or otherwise illustrated on the front piece 602. The front piece 602 also has one or more windows 606 cut or stamped in the front piece 602. As described in further detail below, these windows 606 allow numerical price values to be illustrated therethrough. The slide 600 also includes a back piece 608, which is typically made of a plastic material of opaque coloring, designed to illuminate a white light when radiated from behind by a light source 170 (FIG. 2). The back piece 608 also has one or more pockets 610 having windows 612 therein for holding and displaying numerical inserts, or other types of symbols. The pockets 610 are typically made from a clear plastic material which is adhesively attached to the back piece 608. The windows 612 are stamped, or die-cut into a plastic sheet material which forms the outer surface of the pockets 610.

Figure 22:
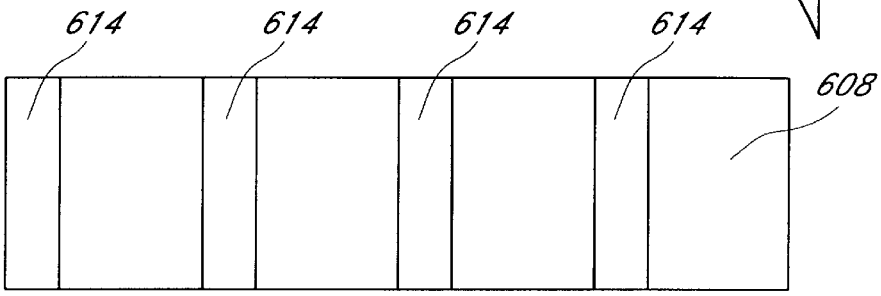
FIG. 22 illustrates double-sided adhesive strips which are attached to a back piece of the sign element of FIG. 21, in order to form pockets, in accordance with one embodiment of the invention.

Referring to FIG. 22, a first process step of forming the pocket 610 is illustrated. One of the first steps is to apply strips of double-sided adhesive tape 614 laterally across the width of the back slide piece 608.

Figure 23:
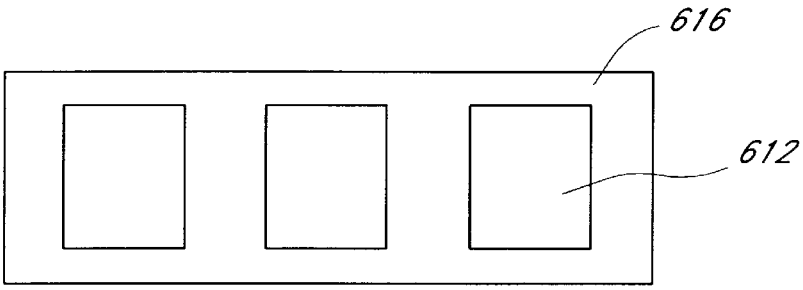
FIG. 23 illustrates a piece of die-cut plastic sheeting, having windows cut therein, for forming pockets which are attached to the back piece of the slide assembly of FIG. 21.

FIG. 23 illustrates a rectangular piece of die-cut plastic sheet material 616 having windows 612 cut therein which forms the front surface of the pockets 610.

Figure 24:
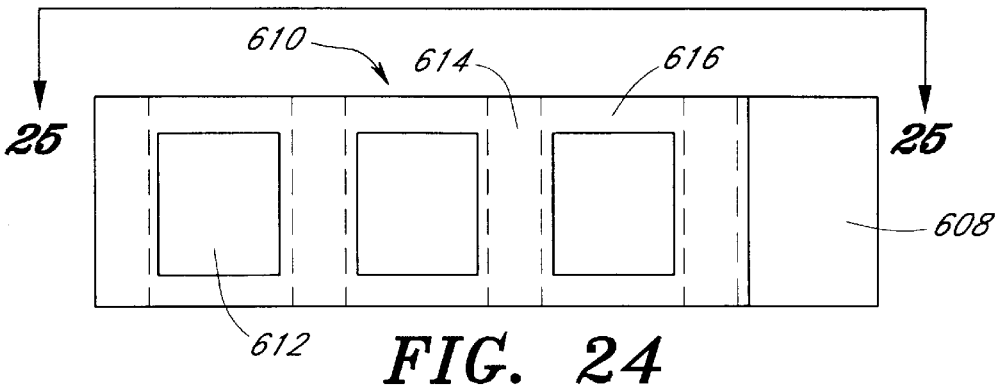
FIG. 24 shows the completed pocket assembly after the die-cut plastic sheeting of FIG. 23 has been attached to the back piece of the sign element by means of the double-sided adhesive strips of FIG. 22, in accordance with one embodiment of the invention.

FIG. 24 illustrates the pockets 610 after the die-cut sheet material 616 has been attached to the back piece 608 by means of the double-sided adhesive strips 614 which are illustrated by dashed lines indicating that they are under the plastic sheet material 616.

Figure 25:
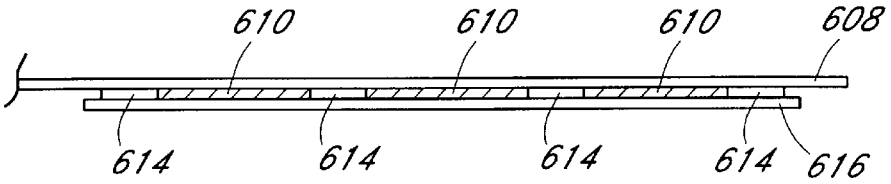
FIG. 25 illustrates a top view, taken along lines 25—25, of the pocket assembly of FIG. 24.

FIG. 25 shows a top view, taken along lines 25—25 of FIG. 24 which illustrates the pockets 610 formed between the back piece 608 and the plastic sheet material 616 which is attached to the back piece 608 by means of double-sided adhesive strips 614. The thickness of the adhesive strips 614 is chosen so as to provide a specified spacing between the sheeting material 616 and the back piece 608, thereby providing a pocket of the specified dimensions. It is also appreciated that the spacing between adjacent strips of double-sided adhesive tape 614 defines the width of each pocket 610.

Figure 26:
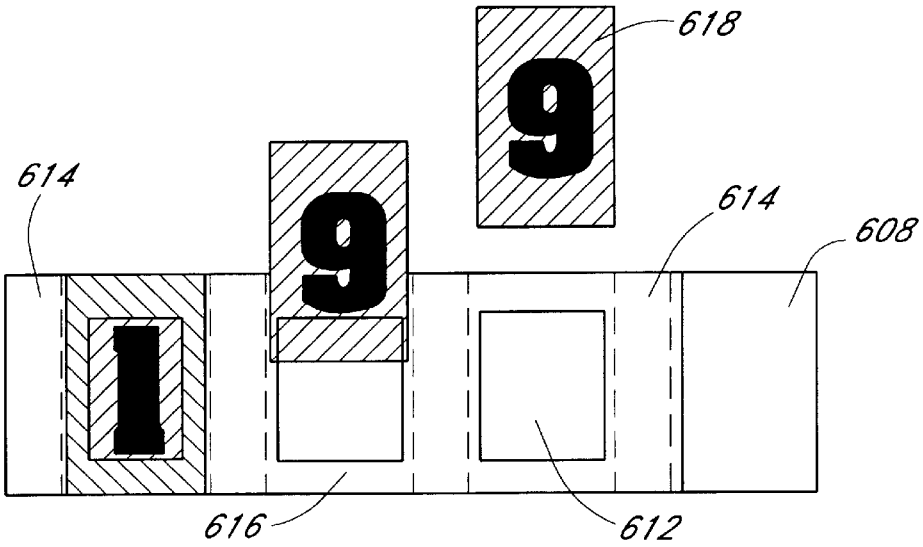
FIG. 26 illustrates numerical inserts being inserted into the pockets formed on the back piece of the sign element of FIG. 21, in accordance with one embodiment of the invention.

FIG. 26 illustrates numerical inserts 618 which may be inserted into the pocket 610, and removed from the pockets 610 as desired. Therefore, the pockets 610 allow easy interchangeability of characters such as numerical inserts 618 if, for example, a price change of a specific menu item is desired.

Figure 27:
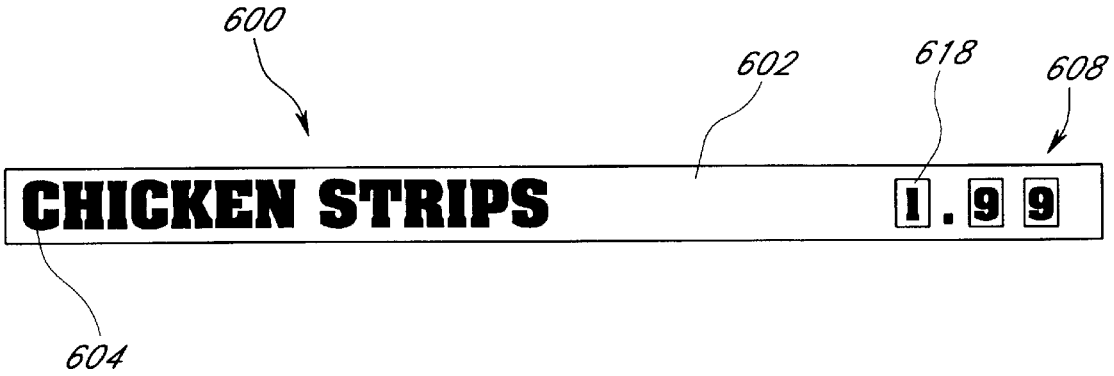
FIG. 27 illustrates a front view of the sign element of FIG. 21 after the front piece has been attached to the back piece and numerical inserts have been inserted into respective pockets formed on the back piece, in accordance with one embodiment of the invention.

FIG. 27 illustrates the slide 600 after the front piece 602 has been attached to the back piece 608. Typically, the characters 604 and numerals are clear so as to show through to the opaque coloring of the back piece 608. However, any color combination of the characters and the rest of the slide background may be implemented. When illuminated from behind, the characters are typically accentuated because of their contrasting color with the rest of the background of the slide 600, thereby providing an attractive and accentuated advertisement.

In one embodiment, the windows 606 which are cut in the front piece 602 are cut so as to be slightly smaller than the pocket windows 612 cut in the plastic sheeting 616. The reason for this is to eliminate a "halo" effect caused by light diffusing through the clear plastic sheeting 616 and radiating outwardly from the internal, peripheral edges which define the pocket windows 612.

Figure 28:
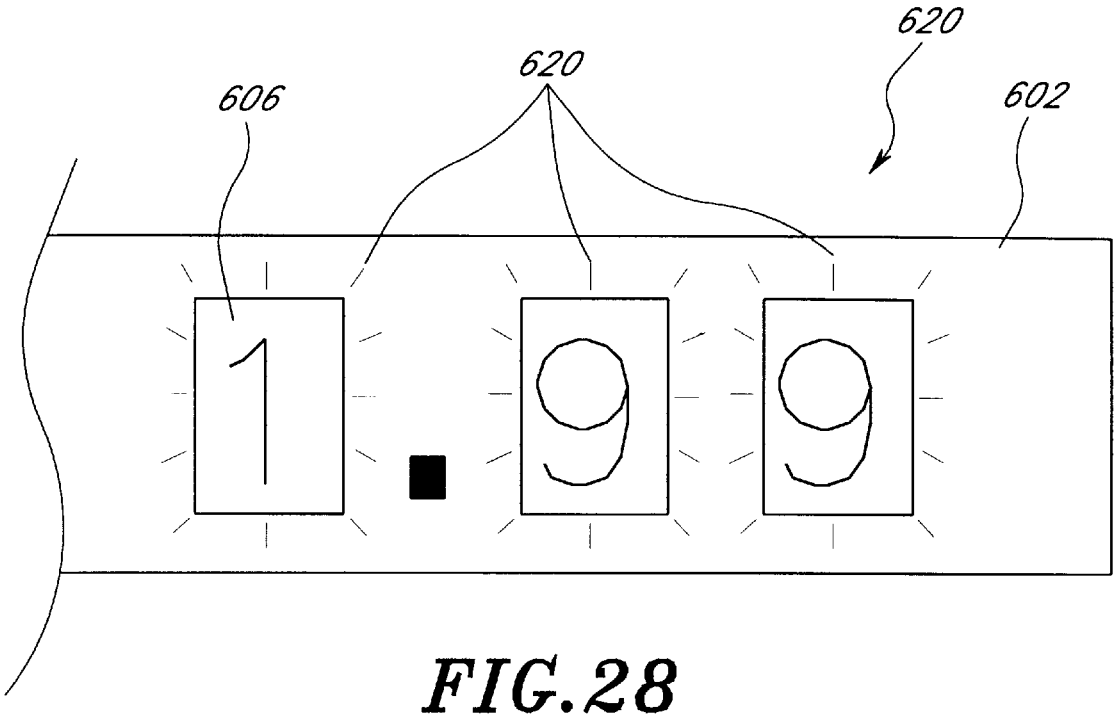
FIG. 28 (PRIOR ART)
FIG. 28 illustrates a portion of a sign element where alphanumeric inserts are displayed through windows cut in a front piece of the sign element and wherein light radiates outwardly from the peripheral edges of the windows so as to create a "halo" effect.

This phenomenon is illustrated in FIG. 28. When the sign element 600 is illuminated from behind, light diffuses through the back piece 608 (FIG. 25) and through the clear plastic sheeting 616. Some of the diffused light radiates outwardly from the internal, peripheral edges of the windows 612 cut in the plastic sheeting 616. This may cause a "halo" or ring of light to surround an insert 618 (FIG. 26) displayed through the window 606 of the front piece 602. Such a halo obscures the contrast between the numerical insert 618 and the rest of the background of the sign element 600 and, additionally, detrimentally affects the overall aesthetic appearance of the sign element 600. Therefore, it is extremely desirable to eliminate this halo effect.

As mentioned above, to reduce or eliminate the "halo" effect, in one embodiment, the front piece 602 is manufactured such that the windows 606 in the front piece 602 are cut slightly smaller than the pocket windows 612 which are cut in the plastic sheeting 616 which forms the pockets 610. As one "rule of thumb," the windows 606 in the front piece 602 should be cut such that after the front piece 602 is properly aligned with the back piece 608, each internal peripheral edge of the front piece window 606 should be "inside" a corresponding internal peripheral edge of a pocket window 612 by a distance of three times the thickness of the plastic sheeting 616. Therefore, if the plastic sheeting 616 is 5 mils (5/1000 inches) thick, each internal peripheral edge of the front piece window 606 should be 15 mils inside the corresponding internal peripheral edge of the pocket window 612.

Figure 29:
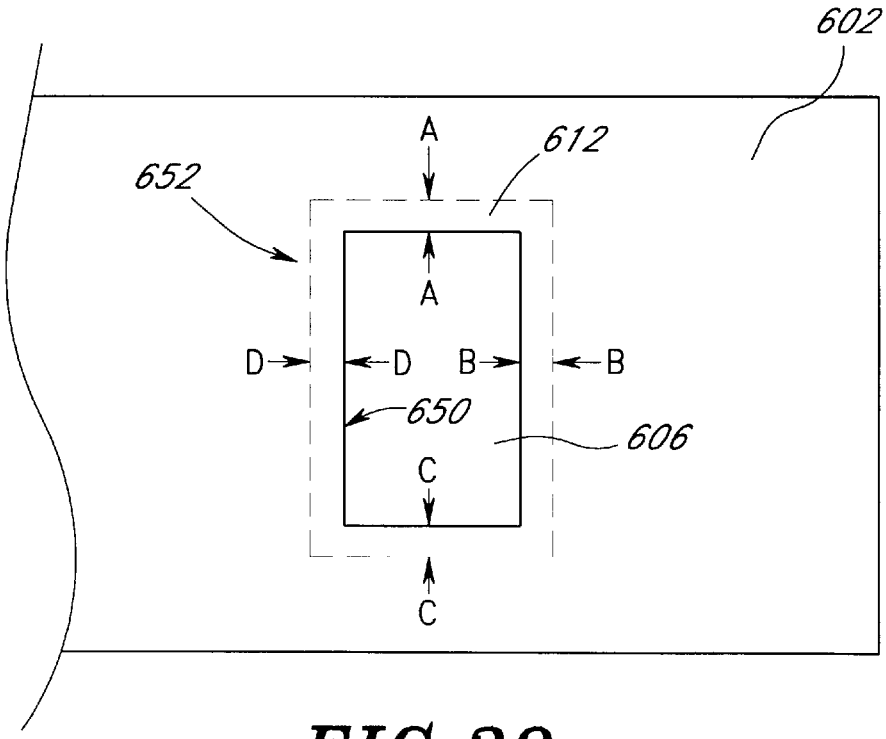
FIG. 29 illustrates a size relationship between a front window cut into a front piece of a sign element and a pocket window cut into a pocket attached to a back piece of the sign element, the size relationship being configured to eliminate the "halo" effect illustrated in FIG. 28, in accordance with one embodiment of the invention.

Referring to FIG. 29, the geometric relationship between the front piece window 606 and the pocket window 612 is illustrated. The internal peripheral edges of the front piece window 606 is illustrated by lines 650 and the internal peripheral edges of the pocket window 612 is illustrated by the dashed lines 652. The dashed lines 652 indicate that the larger pocket window 612 is located behind the front piece window 606 and that the internal peripheral edges 652 of the pocket window 612 would normally not be visible due to the front piece 602. As shown in FIG. 29, the internal peripheral edges 650 of the front piece window 606 are "inside" the internal peripheral edges 652 of the pocket window 612 by distances specified by A—A, B—B, C—C and D—D. Taking our "rule of thumb" described above, if the thickness of the plastic sheeting 616 (FIG. 23) in which the pocket window 612 is cut, is 5 mils, the distances A—A, B—B, C—C and D—D should be approximately 15 mils. In this way, any light which diffuses outwardly from the internal peripheral edges 652 of the pocket window 612 is blocked or obscured by internal, peripheral areas of the front piece window 606, thereby eliminating the "halo" effect.

The above described "rule of thumb" significantly reduces, or eliminates, the "halo" effect. However, the invention is not limited to the above-described size ratios between the front piece windows 606 and the pocket windows 612. For example, the front piece windows may be cut larger or smaller as that described above, depending on different types of materials that may be used which could impact the "halo" effect, the intensity of the back-light, the relative, overall size of the front piece windows and the pocket windows, the thickness of the plastic sheeting 616 (FIG. 23), etc. The general inventive aspect of manufacturing is that the front piece window 606 should be cut smaller than a corresponding pocket window 612 such that the internal peripheral edges 652 of the pocket window 612 is obscured from view so as to substantially, or completely, eliminate the halo effect.

One advantage of the sign element 600, or slide 600, as described above is that, after the correct dimensions are determined, the front piece 602 is easily manufactured by die-cutting and printing relatively inexpensive plastic sheet material. Therefore, if a menu item is desired to be changed, or a new menu item is desired to be advertised, it is a relatively simple matter to cut and print a new front piece 602 which illustrates the desired new menu item or product, or message. In contrast, the back piece 608 along with its corresponding pockets 610 is more difficult to manufacture, and thus, more costly. Therefore, it is desirable to be able to reuse the back piece 608 when a new menu item, for example, is to be displayed.

In accordance with the invention, in order to change the slide assembly 600 to illustrate a new menu item, product, or message, only the front piece 602, which is relatively inexpensive to manufacture, need be replaced. The pricing is easily modified as described above with reference to FIG. 26. Therefore, the only materials that need be replaced is the front piece 602, and possibly the numerical inserts 618 (FIG. 26) in order to completely change a particular sign element, or slide 600. This not only results in a savings of over 50% of the cost in terms of materials but also a significant amount of manufacturing time and cost expended to produce the back piece 608 and the corresponding pockets 610 is saved for each slide 600.

In one embodiment, the front piece 602 is attached to the back piece 608 by means of a double-sided transfer tape which is well-known in the art. The double-sided transfer tape has one side which has a permanent adhesive and another side that has a temporary adhesive. The permanent adhesive side is attached to the back piece 608 while the temporary adhesive side is facing the front piece 602 and sticks to the front piece 602 when the front piece 602 is attached to the back piece 608. However, any method of removably attaching the front piece 602 to the back piece 608, such as a weak glue, "Velcro," etc., may be used in accordance with the invention.

The foregoing describes an adjustable display panel assembly in which a display window may be easily and adjustably partitioned into various desired configurations so as to accommodate a desired number of sign elements of varying sizes and shapes. Therefore, the display panel assembly of the invention may be easily and repeatedly modified to provide different configurations of displays such that new messages, menu items, images, etc. of varying sizes and dimensions may be implemented in the display panel assembly, without changing the overall size of the display panel. Additionally, the invention provides an improved sign element to be used in the adjustable display panel, wherein a front piece is removably attached to a back piece, such that when an old menu item, for example, is to be replaced with a new one, only the front piece of the sign element need be replaced.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A modifiable sign element for use in a display panel for back-lighted signs, comprising:

a front piece having an image illustrated thereon and at least one window cut therein for displaying at least one alphanumeric character therethrough; and a back piece, removably attached to the front piece, said back piece having a plurality of raised elements extending outwardly therefrom, and at least one pocket piece in contact with at least one of said plurality of raised elements so as to define at least one pocket for holding at least one insert therein, wherein the at least one insert has printed thereon the at least one alphanumeric character and, when the front piece is attached to the back piece, the at least one window is aligned with the at least one pocket so as to allow the at least one alphanumeric character to show through the at least one window.

2. The modifiable sign element of claim 1 wherein said at least one pocket includes a piece of transparent sheeting attached to a front surface of the back piece, wherein said transparent sheeting includes at least one pocket window for allowing said at least one insert to show therethrough, said at least one pocket window having a size and shape substantially corresponding to a size and shape of said at least one window of said front piece.

3. The modifiable sign element of claim 2 further comprising at least two strips of double-sided adhesive tape having a first side attached to the front surface of the back piece, wherein the thickness of the strips and the spacing between two adjacent strips define the dimensions of said at least one pocket, and wherein said piece of transparent sheeting is attached to a second side of the strips of double-sided adhesive tape, thereby forming said at least one pocket.

4. The modifiable sign element of claim 3 wherein the size of said at least one pocket window is slightly larger than the at least one window of the front piece such that when the front piece is attached to the back piece, a peripheral boundary defining said at least one pocket window is not visible through said at least one window of said front piece.

5. A method of modifying an adjustable display panel comprising:

removing a sign element held within the adjustable display panel, wherein the sign element includes a first front piece removably attached to a back piece;

detaching the first front piece from the back piece;

removably attaching a second front piece to the back piece in place of the front piece, wherein the second front piece includes:

at least one front window cut in the second front piece which corresponds in position to at least one pocket attached to the back piece, wherein said at least one pocket includes at least one pocket window and a plurality of raised elements interposed between said back piece and said second front pieces and holds at least one alphanumeric insert therein, said alphanumeric insert being displayed through the at least one pocket window and the at least one front window when the second front piece is aligned and removably attached to the back piece; and wherein the at least one front window is cut such that a first set of internal peripheral edges which define the at least one front window are located inside a second set of internal peripheral edges which define the at least one pocket window such that the second set of internal peripheral edges is not visible through the at least one front window, thereby obscuring light which diffuses outwardly from the second set of internal peripheral edges.

6. A modifiable sign element for use in a display panel for back-lighted signs, comprising:

a front piece having an image illustrated thereon and at least one window cut therein for displaying at least one alphanumeric character therethrough;

a back piece, removably attached to the front piece;

at least one pocket piece located adjacent to said back piece;

a plurality of raised elements interposed between said back piece and said at least one pocket piece, said raised elements and said pocket piece defining at least one pocket for holding at least one insert therein, wherein the at least one insert has printed thereon the at least one alphanumeric character and, when the front piece is attached to the back piece, the at least one window is aligned with the at least one pocket so as to allow the at least one alphanumeric character to be visible through the at least one window.

7. The modifiable sign element of claim 6, wherein said raised elements include adhesive strips adapted to receive the front piece.

* * * * *